US011835289B2

(12) United States Patent
Wang et al.

(10) Patent No.: US 11,835,289 B2
(45) Date of Patent: Dec. 5, 2023

(54) REFRIGERATOR WITH DIVIDER

(71) Applicants: QINGDAO HAIER REFRIGERATOR CO., LTD., Shandong (CN); HAIER SMART HOME CO., LTD., Shandong (CN)

(72) Inventors: Jing Wang, Qingdao (CN); Jianru Liu, Qingdao (CN); Dongqiang Cao, Qingdao (CN); Shengyuan Nie, Qingdao (CN)

(73) Assignees: QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 169 days.

(21) Appl. No.: 17/434,365

(22) PCT Filed: Feb. 19, 2020

(86) PCT No.: PCT/CN2020/075886
§ 371 (c)(1),
(2) Date: Aug. 26, 2021

(87) PCT Pub. No.: WO2020/173359
PCT Pub. Date: Sep. 3, 2020

(65) Prior Publication Data

US 2022/0128289 A1 Apr. 28, 2022

(30) Foreign Application Priority Data

Feb. 26, 2019 (CN) ..... 201910143331.3

(51) Int. Cl.
*F25D 23/00* (2006.01)
*F25D 11/02* (2006.01)

(52) U.S. Cl.
CPC ..... *F25D 23/006* (2013.01); *F25D 11/02* (2013.01); *F25D 23/003* (2013.01);
(Continued)

(58) Field of Classification Search
CPC ... F25D 2323/0021; F25D 2323/00284; F25D 2323/00266; F25D 2323/00276;
(Continued)

(56) References Cited

U.S. PATENT DOCUMENTS 4,006,601 A 2/1977 Ballarin et al.
2009/0301115 A1* 12/2009 Sugimoto ..... F25D 23/003 62/507

(Continued)

FOREIGN PATENT DOCUMENTS

CN 201706812 U 1/2011
CN 106642916 A 5/2017

(Continued)

OTHER PUBLICATIONS

English language translation of KR 20080086774. Translated Apr. 2023 (Year: 2008).*

(Continued)

*Primary Examiner* — Cassey D Bauer
(74) *Attorney, Agent, or Firm* — ALSTON & BIRD LLP

(57) ABSTRACT

Provided is a refrigerator (10), including: a cabinet (100) in which a cooling chamber (200) located at a lower side and at least one storage compartment located above the cooling chamber (200) are defined, a bottom air inlet (110*a*) and a bottom air outlet (110*b*) being provided in a bottom of the cabinet (100) in a transverse direction at an interval; a compressor chamber (300) arranged behind the cooling chamber (200), in which a compressor (104), a heat dissipation fan (106) and a condenser (105) are sequentially arranged; and a divider (117) configured to completely (Continued)

isolate the bottom air inlet (110*a*) from the bottom air outlet (110*b*), such that external air entering the condenser (105) and heat dissipation air discharged from the compressor (104) are not crossed. In the refrigerator (10), the freezing chamber (132) is raised, a user has no need to bend down much to access to the freezing chamber (132), and the use experience is improved. In addition, by the divider (117), the bottom air inlet (110*a*) and the bottom air outlet (110*b*) are completely separated, so that the external air entering the condenser (105) and the heat dissipation air discharged from the compressor (104) are not crossed.

8 Claims, 9 Drawing Sheets

(52) U.S. Cl.
CPC ..... *F25D 2321/1411* (2013.01); *F25D 2323/00266* (2013.01); *F25D 2323/00276* (2013.01); *F25D 2323/00284* (2013.01)

(58) Field of Classification Search
CPC ..... F25D 2323/06; F25D 2323/0023; F25D 2323/002–0022; F25D 23/006; F25D 11/02; F25D 23/003; F25D 2321/1411
See application file for complete search history.

(56) References Cited

U.S. PATENT DOCUMENTS

| | | | | |
|---|---|---|---|---|
| 2016/0116204 | A1* | 4/2016 | Li | F04D 25/08 62/506 |
| 2020/0348071 | A1 | 11/2020 | Yang et al. | |

FOREIGN PATENT DOCUMENTS

| | | | | | |
|---|---|---|---|---|---|
| CN | 108195115 | A | | 6/2018 | |
| CN | 108444168 | A | | 8/2018 | |
| CN | 208475771 | U | | 2/2019 | |
| CN | 209893736 | U | | 1/2020 | |
| CN | 209893739 | U | | 1/2020 | |
| CN | 209893746 | U | | 1/2020 | |
| DE | 2458981 | A1 | | 6/1976 | |
| DE | 19933603 | A1 | | 1/2001 | |
| JP | 2001241829 | A | | 9/2001 | |
| JP | 2002-295954 | A | | 10/2002 | |
| JP | 2003-329359 | A | | 11/2003 | |
| JP | 2007085622 | A | | 4/2007 | |
| JP | 2009-030864 | A | | 2/2009 | |
| KR | 2006-0078134 | A | | 7/2006 | |
| KR | 20080086774 | | * | 9/2008 | F25D 23/003 |
| WO | WO2016/000743 | | * | 1/2016 | F25D 23/006 |

OTHER PUBLICATIONS

International Search Report for PCT/CN2020/075886 dated May 9, 2020 with English translation (6 pages).
Written Opinion of the International Searching Authority for PCT/CN2020/075886 dated May 9, 2020 with English translation (5 pages).
Supplementary European Search Report for EP Application No. 20763875.0 dated Mar. 21, 2022 (4 pages).
1st Office Action for EP Application No. 20763875.0 dated Apr. 4, 2022 (7 pages).
1st Office Action for Australia Application No. 2020229400 dated May 30, 2022 (3 pages).
Notice of Acceptance for Australia Patent Application No. 2020229400 dated Nov. 2, 2022 (3 pages).
Decision to Grant for EP Patent Application No. 20763875.0 dated Mar. 2, 2023 (3 pages).
Intention to Grant for EP Patent Appplication No. 20763875.0 dated Oct. 4, 2022 (39 pages).

* cited by examiner

REFRIGERATOR WITH DIVIDER

TECHNICAL FIELD

The present invention relates to the technical field of household appliances, and particularly relates to a refrigerator with a divider between a bottom air inlet and a bottom air outlet.

BACKGROUND ART

In an existing refrigerator, a freezing chamber is generally located at a lower part of the refrigerator; a cooling chamber is located at a rear part of an outer side of the freezing chamber; and a compressor chamber is located behind the freezing chamber. The freezing chamber needs to leave a space for the compressor chamber, so that the freezing chamber is specially shaped, which limits a depth of the freezing chamber.

SUMMARY OF THE INVENTION

An objective of the present invention is to provide a refrigerator in which a bottom air inlet and a bottom air outlet are completely separated.

A further objective of the present invention is to reduce noise generated by vibration of a heat dissipation fan.

A still further objective of the present invention is to stably fix a divider.

Particularly, the present invention provides a refrigerator, including:

a cabinet in which a cooling chamber located at a lower side and at least one storage compartment located above the cooling chamber are defined, a bottom air inlet and a bottom air outlet being formed in a bottom of the cabinet in a transverse direction at an interval;

a compressor chamber arranged behind the cooling chamber, in which a compressor, a heat dissipation fan and a condenser are sequentially arranged; and a divider configured to completely separate the bottom air inlet from the bottom air outlet to allow external air to enter the compressor chamber via the bottom air inlet located at one transverse side of the divider under the action of the heat dissipation fan, sequentially flow through the condenser and the compressor, and finally flow out from the bottom air outlet located on the other transverse side of the divider, such that the external air entering the condenser and heat dissipation air discharged from the compressor are not crossed.

Optionally, the refrigerator further includes a fan fixing frame fixed in the compressor chamber in a front-rear direction and used to fix the heat dissipation fan. The divider is fixed to the fan fixing frame.

Optionally, the divider is snap-fixed to the fan fixing frame.

Optionally, the divider has a first separation part, and an accommodating slot is formed in a rear end of the first separation part; a front end of the fan fixing frame extends forwards to form a protrusion; and the protrusion of the fan fixing frame is fitted in the accommodating slot to realize snap fixing between the divider and the fan fixing frame.

Optionally, a rear part of the first separation part includes a main body part, a first flange and a second flange, the accommodating slot is formed in the main body part, and the first flange and the second flange are formed by extending backwards from left and right sides of a rear end of the main body part respectively; and a front part of the fan fixing frame is clamped between the first flange and the second flange.

Optionally, the refrigerator further includes an evaporating dish fixed in the compressor chamber; the condenser is arranged in the evaporating dish; and the divider is fixed to the evaporating dish.

Optionally, the divider is fixed to the evaporating dish by abutting against each other.

Optionally, the divider has a second separation part, and a lower part of a rear end of the second separation part is sunken forwards to form a horizontal abutting surface; a front wall of the evaporating dish extends forwards to form a protrusion; and the protrusion of the evaporating dish is fitted below the horizontal abutting surface to realize fixing of the divider and the evaporating dish by abutting against each other.

Optionally, the refrigerator further includes a supporting plate configured to be bottoms of the cabinet and the compressor chamber; the divider is provided with a plurality of claws at its bottom; the supporting plate is correspondingly provided with a plurality of clamping holes; and the plurality of claws are fixed to the plurality of clamping holes so that the divider is fixed to the supporting plate.

Optionally, the divider is an integrally molded piece.

Optionally, the refrigerator further includes:

an evaporator arranged in the cooling chamber and configured to cool an air flow entering the cooling chamber.

In the refrigerator of the present invention, the cooling chamber occupies a lower space in a freezing liner by defining the cooling chamber at the bottom, so that the freezing chamber is raised, a user has no need to bend down much to access to the freezing chamber, and the use experience is improved. In addition, by the divider, the bottom air inlet and the bottom air outlet are completely separated, so that external air entering the condenser and heat dissipation air discharged from the compressor are not crossed.

Further, in the refrigerator of the present invention, the divider is fixed to the fan fixing frame; thus on one hand, the installation stability of the divider can be guaranteed, and on the other hand, noise generated by vibration of the heat dissipation fan can be reduced.

Further, in the refrigerator of the present invention, the divider is also fixed to the evaporating dish and the supporting plate, and is convenient to install and stable.

The above, as well as other objectives, advantages, and features of the present invention, will be better understood by those skilled in the art according to the following detailed description of specific embodiments of the present invention taken in conjunction with the accompanying drawings.

BRIEF DESCRIPTION OF THE DRAWINGS

In the following part, some specific embodiments of the present invention will be described in detail in an exemplary rather than limited manner with reference to the accompanying drawings. The same reference numerals in the accompanying drawings indicate the same or similar components or parts. Those skilled in the art should understand that these accompanying drawings are not necessarily drawn to scale. In the drawings.

DETAILED DESCRIPTION OF THE INVENTION

Figure 1:
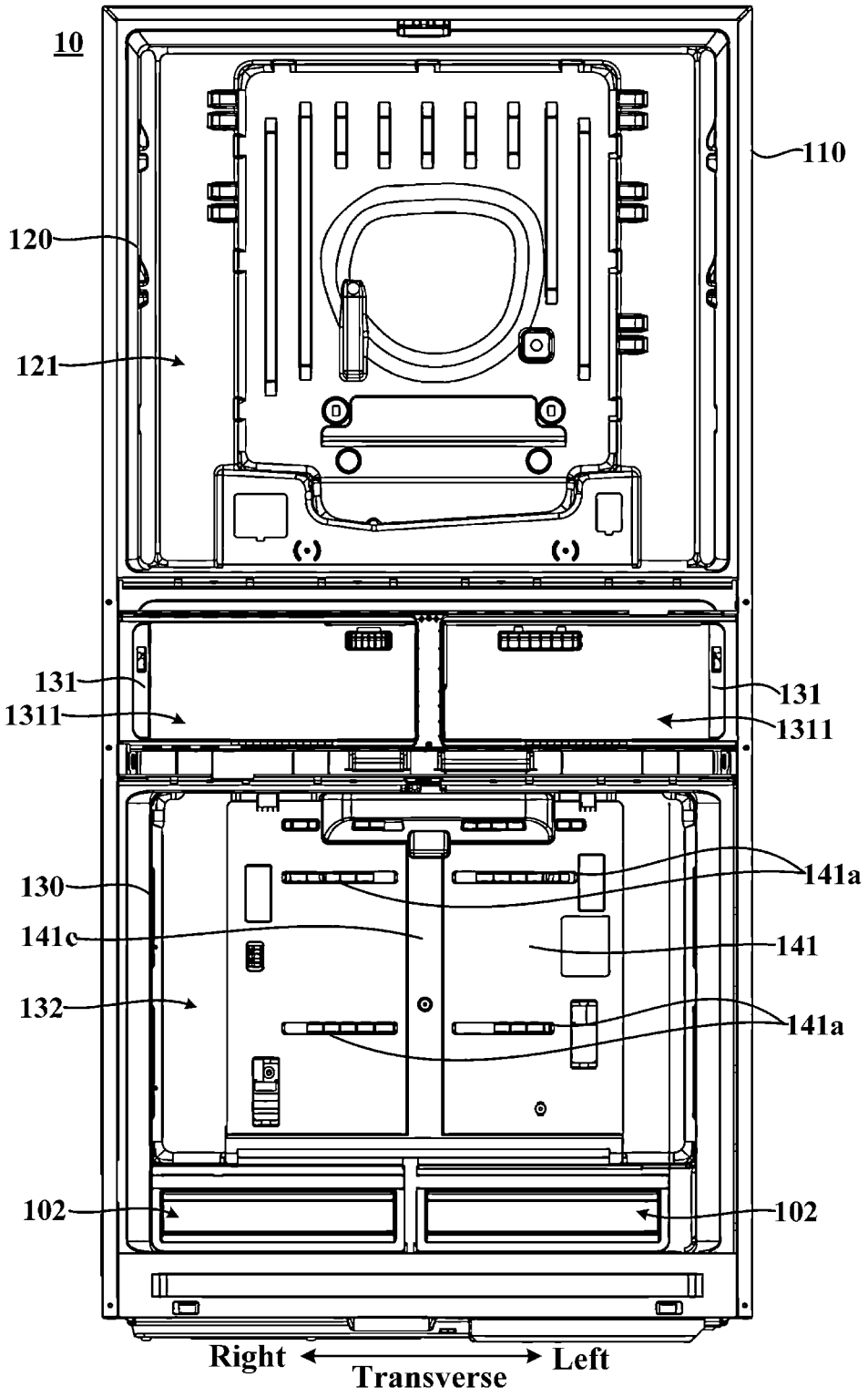
FIG. 1 is a schematic front view of a refrigerator according to an embodiment of the present invention.

The present embodiment provides a refrigerator 10. In the following description, the orientation or positional relationship indicated by "front", "rear", "upper", "lower", "left", "right", etc. are based on the orientation of the refrigerator 10 itself as a reference. "Front" and "rear" refers to the direction indicated in FIG. 6. As shown in FIG. 1, "transverse" refers to a direction parallel to a width direction of the refrigerator 10. "Left" refers to the transverse left side of the refrigerator with reference to the refrigerator 10. "Right" refers to the transverse right side of the refrigerator with reference to the refrigerator 10.

Figure 2:
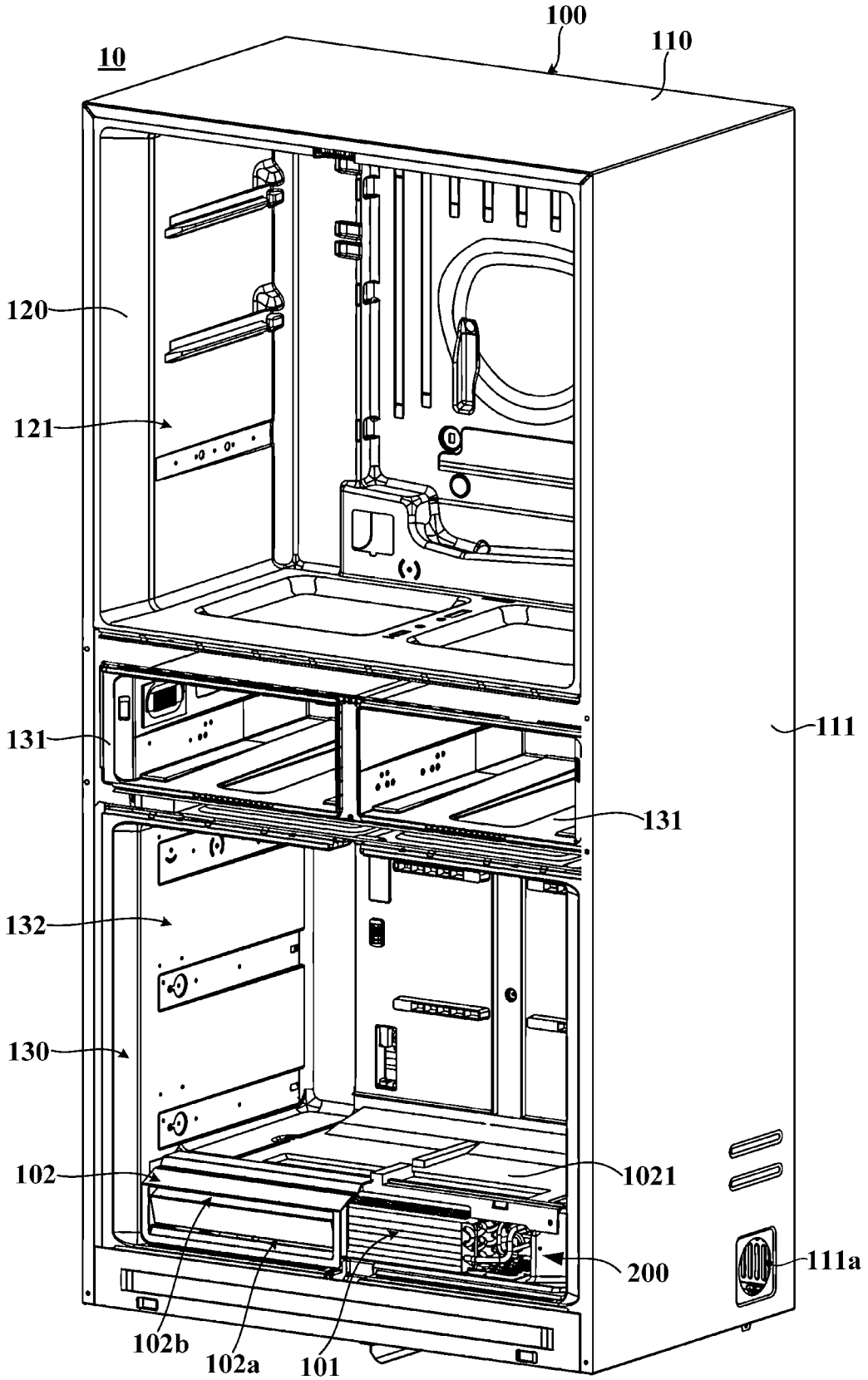
FIG. 2 is a schematic three-dimensional view of the refrigerator shown in FIG. 1

FIG. 1 is a schematic front view of a refrigerator 10 according to an embodiment of the present invention. FIG. 2 is a schematic three-dimensional view of the refrigerator 10 shown in FIG. 1. The refrigerator 10 may generally include a cabinet 100. The cabinet 100 includes a housing 110 and a storage liner arranged on an inner side of the housing 110. A space between the housing 110 and the storage liner is filled with a heat insulation material (to form a foamed layer). A storage compartment is defined in the storage liner. The storage liner may generally include a freezing liner 130, a variable-temperature liner 131, a refrigeration liner 120, etc. The storage compartment includes a freezing chamber 132 defined in the freezing liner 130 and a refrigeration chamber 121 defined in the refrigeration liner 120. A variable-temperature chamber 1311 is defined in the variable-temperature liner 131. A front side of the storage liner is also provided with a door to open or close the storage compartment. The door is omitted in FIG. 1 and FIG. 2.

Those skilled in the art can realize that the refrigerator 10 of the present embodiment may further include an evaporator 101, an air supply fan (not shown), a compressor 104, a condenser 105, a throttling element (not shown) and the like. The evaporator 101 is connected to the compressor 104, the condenser 105 and the throttling element through a refrigerant pipeline to form a refrigeration cycle loop. The evaporator cools down when the compressor 104 is initiated to cool air flowing therethrough. In the present embodiment, the freezing liner 130 is located at a lower part of the cabinet 100, and a cooling chamber 200 located at the bottom is defined in the freezing liner. The evaporator 101 is arranged in the cooling chamber 200 to cool air flow entering the cooling chamber 200. The freezing chamber 132 defined by the freezing liner 130 is located above the cooling chamber 200 so that the cooling chamber 200 is located at the bottommost part of the cabinet 100. Specifically, the evaporator 101 is of a flat cube shape as a whole arranged transversely in the cooling chamber 200. That is, a length-width surface of the evaporator 101 is parallel to a horizontal plane, a thickness surface of the evaporator is perpendicular to the horizontal plane, and the thickness size of the evaporator 101 is obviously less than the length size thereof. The evaporator 101 is transversely arranged in the cooling chamber 200 to avoid the evaporator 101 from occupying more space, thus ensuring a storage volume of the freezing chamber 132 above the cooling chamber 200. At least one front return air inlet communicated with the freezing chamber 132 is formed in a front side of the cooling chamber 200, so that return air flow of the freezing chamber 132 enters the cooling chamber 200 through the at least one front return air inlet to be cooled by the evaporator 101, and thus air flow circulation is formed between the cooling chamber 200 and the freezing chamber 132.

In a traditional refrigerator 10, the freezing chamber 132 is located at the bottommost part of the refrigerator 10, and a compressor chamber 300 is located at a rear part of the freezing chamber 132; thus the freezing chamber 132 is inevitably formed into a specially-shaped space for leaving a space for the compressor chamber 300, which reduces the storage volume of the freezing chamber 132 and brings the following problems. In one aspect, the freezing chamber 132 is located at a relatively low position, so that a user needs to bend down or squat much to access to the freezing chamber 132, which is inconvenient for a user, especially old people, to use. In another aspect, a depth of the freezing chamber 132 is reduced, so that in order to ensure the storage volume of the freezing chamber 132, the space in a height direction of the freezing chamber 132 needs to be enlarged. Therefore, the user needs to stack items in the height direction when placing the items to the freezing chamber 132, and it is inconvenient for the user to find them. Furthermore, the items located at a bottom of the freezing chamber 132 are tend to be blocked, so that it is not easy for the user to find them and the items are forgotten, resulting in deterioration and waste. Furthermore, the freezing chamber 132 is specially-shaped and is not a rectangular space, so it is inconvenient for those items which are relatively large in volume and not easy to segment to be placed in the freezing chamber 132. In the refrigerator 10 of the present embodiment, the cooling chamber 200 is defined in a bottom space of the freezing liner 130, and the freezing chamber 132 is defined above the cooling chamber 200, so that the cooling chamber 200 occupies a lower space in a freezing liner 130, the freezing chamber 132 is raised, the user has no need to bend down much to access to the freezing chamber 132, and the use experience is improved. Meanwhile, the compressor chamber 300 may be located behind the cooling chamber 200, so that the freezing chamber 132 does not need to leave a space for the compressor chamber 300. The freezing chamber 132 is a rectangular space, so that the items can be stored in spread layout instead of stacked storage, which is convenient for the user to find an item and saves the time and energy of the user. Meanwhile, the items which are relatively large in volume and not easy to segment are convenient to place, and the problem that relatively large items cannot be placed in the freezing chamber 132 is solved.

In some embodiments, the air supply fan in the refrigerator 10 is arranged in the cooling chamber 200 and configured to suck the return air flow into the cooling chamber 200 to be cooled by the evaporator 101 and promote the cooled air flow to flow to the freezing chamber 132 and the variable-temperature chamber 1311. The refrigerator 10 of the present embodiment further includes a freezing chamber air supply duct 141 and a variable-temperature chamber air supply duct 1312. The freezing chamber air supply duct 141 communicates with an air outlet end of the air supply fan and is configured to convey part of the air flow cooled by the evaporator 101 into the freezing chamber 132. The freezing chamber air supply duct 141 is arranged on an inner side of a rear wall of the freezing liner 130 and has a plurality of air supply outlets 141*a* communicating with the freezing chamber 132.

Figure 3:
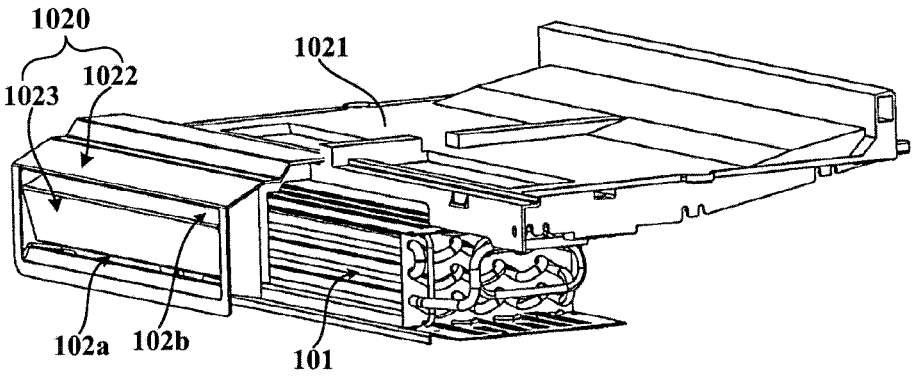
FIG. 3 is a schematic three-dimensional view of partial components of the refrigerator shown in FIG. 1.

FIG. 3 is a schematic three-dimensional view of partial components of the refrigerator 10 shown in FIG. 1. In some embodiments, the refrigerator 10 further includes a shield plate 102. The shield plate 102 includes a top cover 1021 located above the evaporator and at least one front cover group 1020. At least one of the front return air inlets aforementioned is formed in a front side of each front cover group 1020. The top cover 1021, the at least one front cover group 1020 and the rear wall, a bottom wall and two transverse side walls of the freezing liner 130 jointly define the cooling chamber 200. Correspondingly, the transverse side walls of the freezing liner 130 form transverse side walls of the cooling chamber 200. In the present embodiment, there are two front cover groups 1020, and the two front cover groups 1020 are distributed in a transverse direction. In the present embodiment, the refrigerator 10 further includes a vertical division plate (not shown). The vertical division plate extends downwards from a top wall of the freezing liner 130 to an upper surface of the top cover 1021 to divide the freezing chamber 132 into two freezing spaces transversely distributed. A mounting slot 141*c* cooperating with the vertical division plate is formed in an air duct front cover plate of the freezing chamber air supply duct 141. In the present embodiment, the two front cover groups 1020 are distributed at an interval in the transverse direction. The vertical division plate includes a front blockage part extending to a position between the two front cover groups 1020 and located on a front side of the evaporator 101 to block a gap between the two front cover groups 1020, thereby completely isolating the air flows in the two freezing spaces of the freezing chamber 132, so that return air of the freezing space located on a transverse right side enters the cooling chamber 200 through the front return air inlet of the front cover group 1020 located on the transverse right side, and return air of the freezing space located on a transverse left side enters the cooling chamber 200 through the front return air inlet of the front cover group 1020 located on the transverse left side.

Figure 4:
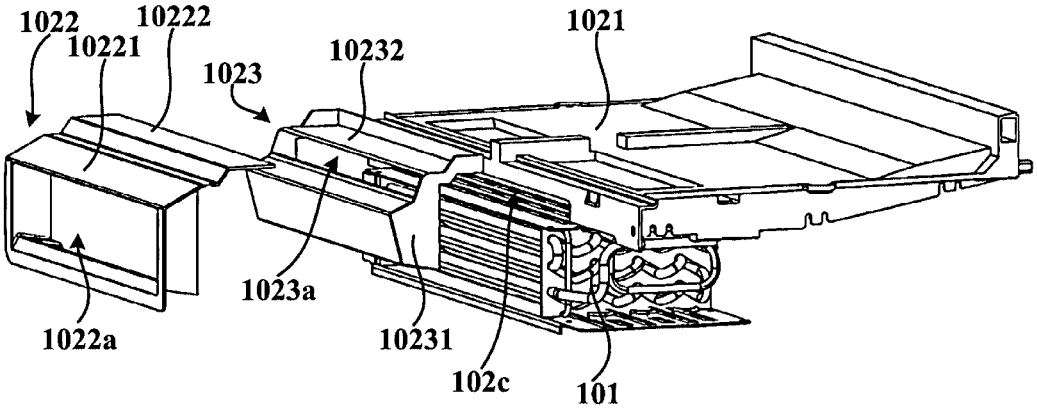
FIG. 4 is a schematic exploded view of partial components of the refrigerator shown in FIG. 3.

FIG. 4 is a schematic exploded view of partial components of the refrigerator 10 shown in FIG. 3. Two front return air inlets are formed in the front side of each front cover group 1020. The two front return air inlets are labeled as a first front return air inlet 102*a* and a second front return air inlet 102*b* respectively. Each front cover group 1020 includes a front decorative cover 1022 and a front air duct cover 1023. A front end part 10221 of the front decorative cover 1022 is located in front of a front end of the evaporator 101, and the front end part 10221 is spaced from the front end of the evaporator 101. A first opening 1022*a* is formed in a front wall of the front end part 10221 of the front decorative cover 1022. A rear side of the front end part 10221 of the front decorative cover 1022 is opened. A front end part 10231 of the front air duct cover 1023 is located at the front end of the evaporator 101. The front end part 10231 of the front air duct cover 1023 is inserted forwards into the front decorative cover 1022 from the opened part of the rear side of the front end part 10221 of the front decorative cover 1022 to divide the first opening 1022*a* into the first front return air inlet 102*a* located a lower side and the second front return air inlet 102*b* located at an upper side.

Specifically, a bottom wall of the front end part 10231 of the front air duct cover 1023 and a bottom wall of the front end part 10221 of the front decorative cover 1022 define a first return air passage connected to the first front return air inlet 102*a*, and the first return air passage is located in front of the evaporator 101. That is, the front end part 10231 of the front air duct cover 1023 is inserted into the front decorative cover 1022 from the opened part of the rear side of the front end part 10221 of the front decorative cover 1022 to such an extent that the bottom wall of the front end part 10231 of the front air duct cover 1023 is spaced from the bottom wall of the front end part 10221 of the front decorative cover 1022 to form the first return air passage connected to the first front return air inlet 102*a*, such that at least part of the return air flow entering the first return air passage via the first front return air inlet 102*a* enters the evaporator 101 from the front of the evaporator 101 to be cooled by the evaporator 101. A second opening 1023 connected to the second front return air inlet 102*b* is formed in an upper section of the front end part 10231 of the front air duct cover 1023, and the second opening 1023*a* is located at an upper front side of the evaporator 101. A lower surface of the top cover 1021 is spaced apart from an upper surface of the evaporator 101, and a front end of the top cover 1021 is located at an upper rear side of the front end of the evaporator 101. That is, the top cover 1021 does not completely cover a position above the upper surface of the evaporator 101. In addition, an air shield material (not shown) is filled between the lower surface of the top cover 1021 and the upper surface of the evaporator 101, and the top cover 1021 and the upper surface of the evaporator 101 are spaced apart to form an interval space 102*c*. The interval space 102*c* is filled with the air shield material which may be air shield foam. In addition, the front air duct cover 1023 includes a first shielding part 10232 located at an upper rear side of the second opening 1023*a*. A rear end of the first shielding part 10232 abuts against the front end of the top cover 1021 to close the part above the upper surface of the evaporator 101 that is not shielded by the top cover 1021, so that a second return air passage connected to the second opening 1023*a* and the second front return air inlet 102*b* is formed between the first shielding part 10232 and the upper surface of the evaporator 101, and at least part of return air flow entering the second return air passage via the second front return air inlet 102*b* enters the evaporator 101 from the position above the evaporator 101 to be cooled by the evaporator. Since the interval space 102*c* between the top cover 1021 and the upper surface of the evaporator 101 is filled with the air shield material, the return air flow entering the second return air passage is prevented from flowing directly backwards without passing through the evaporator 101, and the return air flow entering the second return air passage flows down and enters the evaporator 101 from the upper surface of the evaporator 101. The front decorative cover 1022 includes a second shielding part 10222 bent and extending towards a rear upper side from the rear edge of the upper end of the front end part 10221. The second shielding part 10222 is located above the first shielding part 10232 and extends to be lap jointed with the upper surface of the top cover 1021 to completely shield an upper side of the first shielding part 10232. Furthermore, the second shielding part 10222 has a shape that adapts to a shape of the first shielding part 10232 so that the second shielding part 10222 and the first shielding part 10232 are in close fit to avoid air leakage.

A temperature around a front end surface of the evaporator 101 is greatly different from that of the return air flow, which easily causes frost on the front end surface of the evaporator 101. If the front end surface of the evaporator 101 is not frosted or is frosted a little, and the front end surface of the evaporator 101 can still allow air flow to pass, a part of the return air flow of the freezing chamber 132 enters the first return air passage via the first front return air inlet 102*a*, and another part of the return air flow of the freezing chamber enters the second return air passage via the second front return air inlet 102*b*. A part of air flow entering the first return air passage enters the evaporator 101 from the front of the evaporator 101 (i.e., the front end surface of the evaporator 101) to be cooed by the evaporator 101, and another part of the air flow entering the first return air passage flows up to the second return air passage and flows down through the second return air passage to enter the evaporator 101, so that part of the return air flow enters the evaporator 101 from the front of the evaporator 101, and part of the return air flow enters the evaporator 101 from an upper side of the evaporator 101, so as to ensure full heat exchange between the return air flow and the evaporator 101 to enhance the refrigeration effect of the refrigerator 10. If the front end surface of the evaporator 101 is frosted a lot and thus the air flow cannot enter the evaporator 101, the return air flow of the freezing chamber 132 may enter the second return air passage via the second front return air inlet 102*b* located above and flow down through the second return air passage to enter the evaporator 101 to be cooled from the upper surface of the evaporator 101, which can still ensure the refrigeration effect of the refrigerator 10. In the refrigerator 10 of the present embodiment, by means of special design of structures of the top cover 1021, the front decorative cover 1022 and the front air duct cover 1023, the heat exchange efficiency of the return air flow of the freezing chamber 132 and the evaporator 101 is guaranteed, and the refrigeration effect of the refrigerator 10 is enhanced. In addition, when the front end surface of the evaporator 101 is frosted, it can still ensure that the return air flow can enter the evaporator 101 to be cooled by the evaporator 101, so that the problem of reduction in the refrigeration effect of the existing refrigerant 10 caused by the frosting of the evaporator 101 is solved, and the overall performance of the refrigerator 10 is improved.

In the refrigerator 10 of the present embodiment, the refrigeration liner 120 is located above the variable-temperature liner 131, and a refrigeration chamber 121 is defined in the refrigeration liner 120. The refrigerator 10 of the present embodiment further includes a refrigeration evaporator (not shown), a refrigeration fan (not shown) and a refrigeration air supply duct (not shown). A refrigeration evaporator chamber is defined at a lower part on the inner side of the rear wall of the refrigeration liner 120. The refrigeration evaporator and the refrigeration fan are arranged in the refrigeration evaporator chamber. The refrigeration air supply duct is arranged on the inner side of the rear wall of the refrigeration liner 120, and has a refrigeration air supply inlet communicated with an air outlet end of the refrigeration fan and a refrigeration air supply outlet communicated with the refrigeration chamber 121. The refrigeration fan is configured to promote the air flow cooled by the refrigeration evaporator to flow through the refrigeration air supply duct into the refrigeration chamber 121 to adjust a temperature of the refrigeration chamber 121. At least one refrigeration return air inlet is formed in a front side of the refrigeration evaporator chamber to guide, through the refrigeration return air inlet, return air flow of the refrigeration chamber 121 into the refrigeration evaporator chamber to be cooled by the refrigeration evaporator, thereby forming air flow circulation between the refrigeration chamber 121 and the refrigeration evaporator chamber.

As well known to those skilled in the art, the temperature in the refrigeration chamber 121 is generally between 2° C. and 10° C., preferably 4° C. to 7° C. A temperature in the freezing chamber 132 is generally from −22° C. to −14° C. The variable-temperature chamber 1311 may be adjusted to −18° C. to 8° C. at will. Different types of items have different optimal storage temperatures, and are suitable for being stored at different positions. For example, fruits and vegetables are suitable for being stored in the refrigeration chamber 121, and meats are suitable for being stored in the freezing chamber 132.

Figure 5:
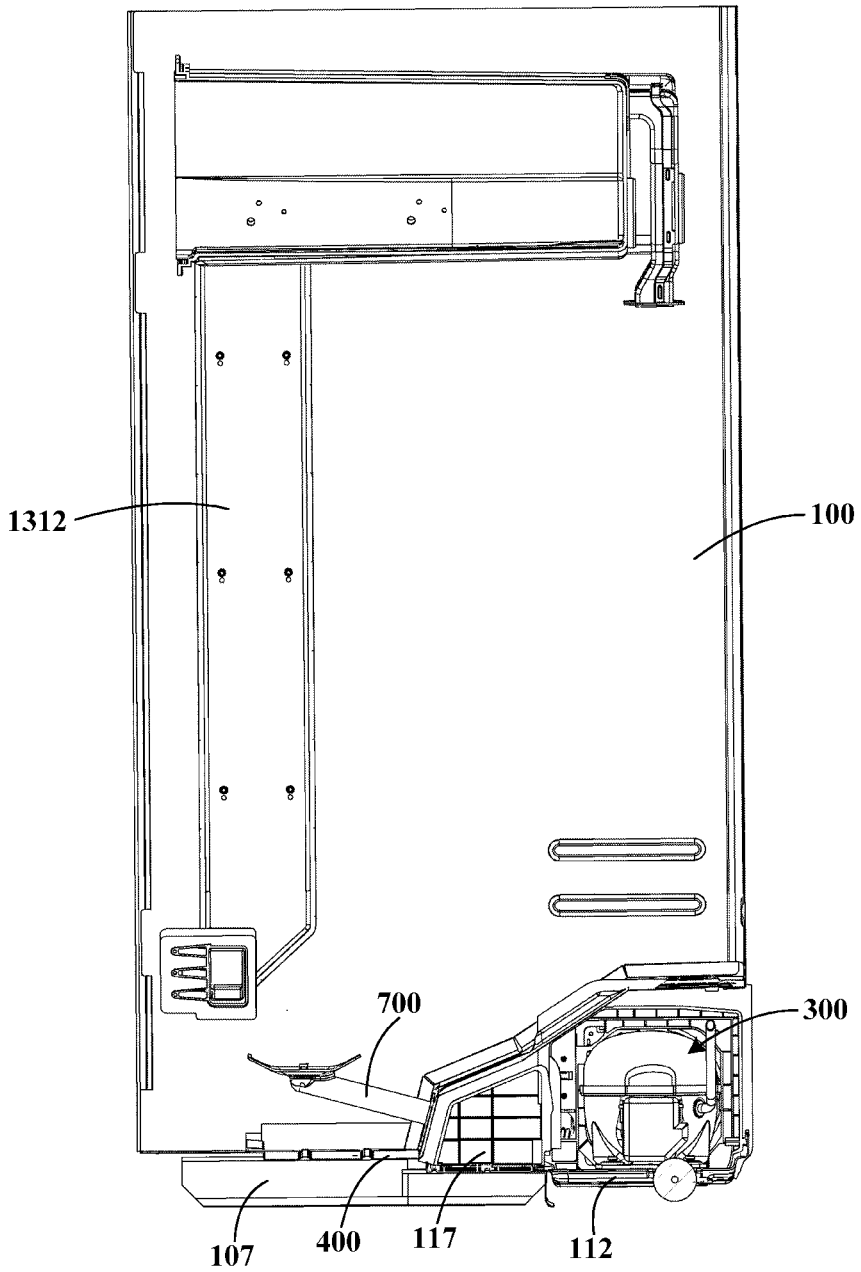
FIG. 5 is a schematic partial cross-sectional view of the refrigerator shown in FIG. 1.
Figure 6:
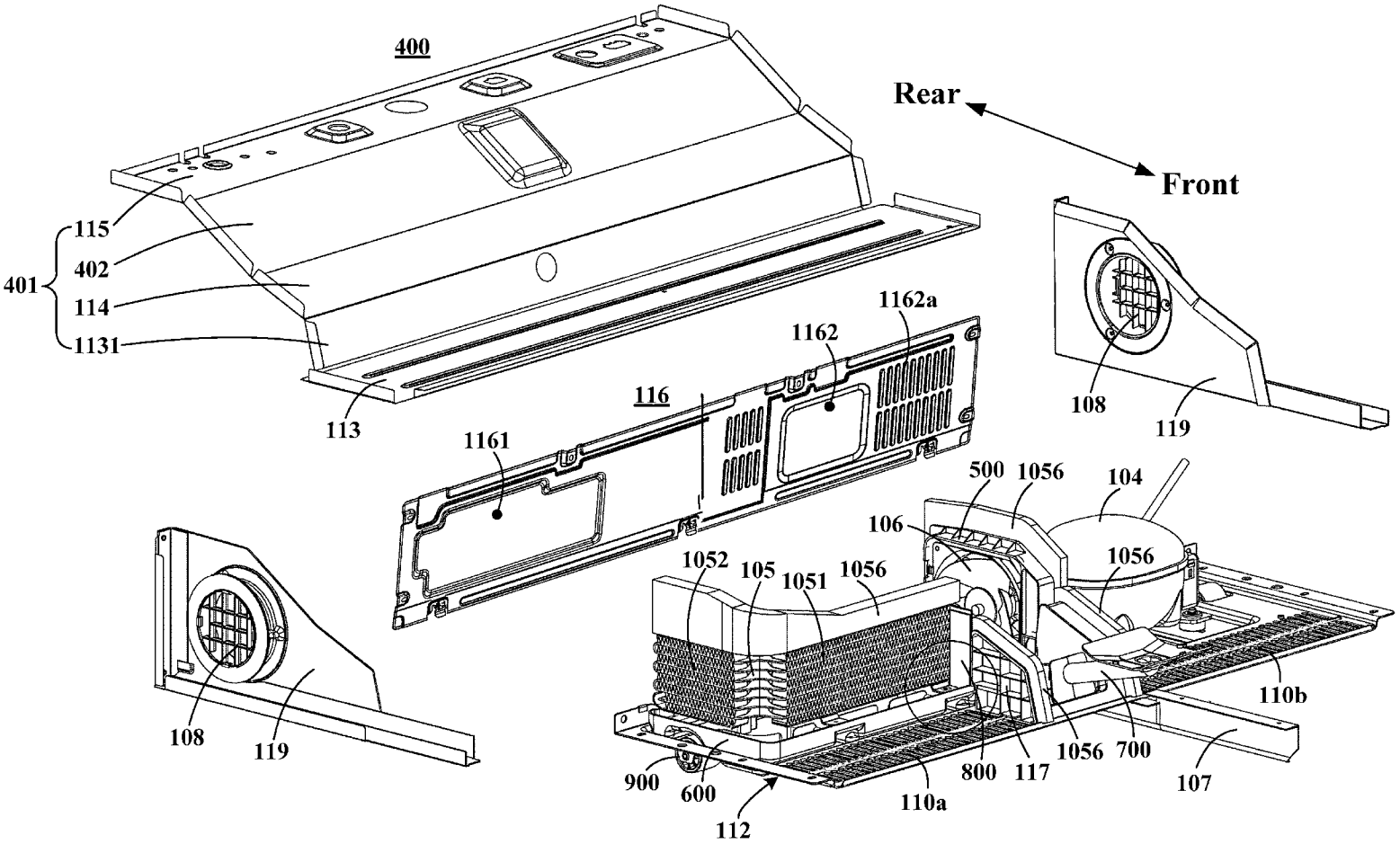
FIG. 6 is a schematic exploded view of a compressor chamber of the refrigerator shown in FIG. 1.
Figure 7:
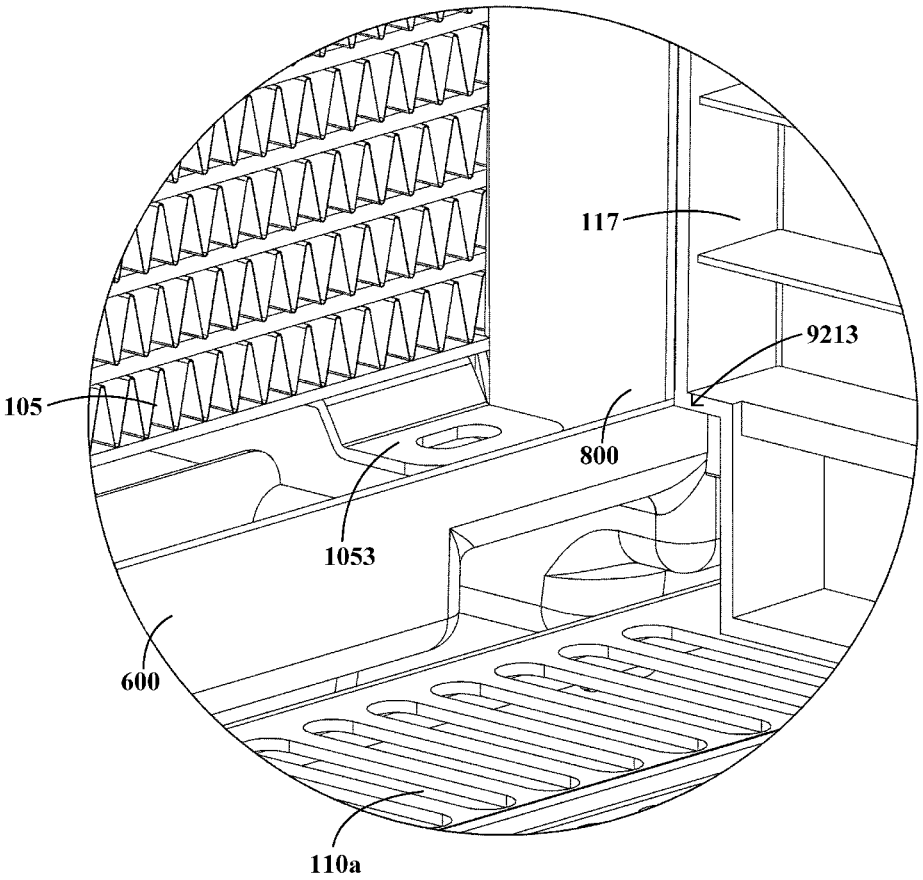
FIG. 7 is a schematic partial enlarged view of FIG. 6.
Figure 8:
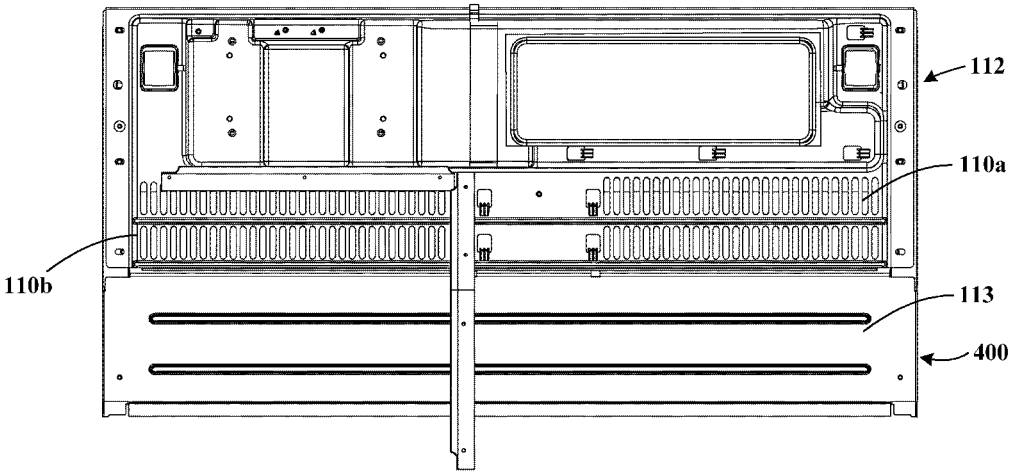
FIG. 8 is a schematic bottom view of a compressor chamber of the refrigerator shown in FIG. 6.

FIG. 5 is a schematic partial cross-sectional view of the refrigerator 10 shown in FIG. 1. FIG. 6 is a schematic exploded view of a compressor chamber 300 of the refrigerator 10 shown in FIG. 1. FIG. 7 is a schematic partial enlarged view of FIG. 6. FIG. 8 is a schematic bottom view of the compressor chamber 300 of the refrigerator 10 shown in FIG. 6. The compressor chamber 300 is defined at a bottom of the cabinet 100, and the compressor chamber 300 is located behind the cooling chamber 200, so that the whole compressor chamber 300 is located below the freezing chamber 132. As mentioned above, the freezing chamber 132 has no need to leave a space for the compressor chamber 300 any more, which ensures the depth of the freezing chamber 132 and facilitates the placement of items which are relatively large in volume and not easy to segment. The refrigerator 10 further includes a heat dissipation fan 106. The heat dissipation fan 106 may be an axial flow fan. The compressor 104, the heat dissipation fan 106, and the condenser 105 are sequentially arranged in the compressor chamber 300 at intervals in a transverse direction.

In some embodiments, at least one rear air outlet hole 1162*a* is formed in a section 1162 of a rear wall of the compressor chamber 300 corresponding to the compressor 104.

In practice, prior to the present invention, a general design idea of those skilled in the art is that a rear air inlet hole facing the condenser 105 and a rear air outlet hole 1162*a* facing the compressor 104 are formed in the rear wall of the compressor chamber 300, and the circulation of heat dissipation air flow is completed at a rear part of the compressor chamber 300. Or, ventilation holes are respectively formed in a front wall and the rear wall of the compressor chamber 300 to form a heat dissipation air circulation path in the front-rear direction. For improving the heat dissipation effect of the compressor chamber 300, those skilled in the art generally increase the number of rear air inlet holes and rear air outlet holes 1162*a* in the rear wall of the compressor chamber 300 to enlarge a ventilation area, or enlarge a heat exchange area of the condenser 105. For example, a U-shaped condenser with a larger heat exchange area is used.

The applicant creatively recognized that the heat exchange area of the condenser 105 and the ventilation area of the compressor chamber 300 are not as larger as better. In a conventional design solution of enlarging the heat exchange area of the condenser 105 and the ventilation area of the compressor chamber 300, non-uniform heat dissipation of the condenser 105 is caused, and a refrigerating system of the refrigerator 10 is adversely affected. Hence, the applicant jumped out of the conventional design idea and creatively proposed a new solution different from the conventional design. A bottom air inlet 110*a* close to the condenser 105 and a bottom air outlet 110*b* close to the compressor 104 are defined at a bottom wall of the cabinet to complete a circulation of the heat dissipation air flow at a bottom of the refrigerator 10. The space between the refrigerator 10 and a supporting surface is fully used, a distance between the rear wall of the refrigerator 10 and a cupboard does not need to be increased, a space occupied by the refrigerator 10 is reduced and good heat dissipation of the compressor chamber 300 is ensured. Therefore, the problem that heat dissipation of the compressor chamber 300 and space occupation of an embedded refrigerator 10 cannot be balanced is fundamentally solved, and it is of particularly important significance. Supporting rollers 900 may also be arranged at four corners of the bottom wall of the cabinet 100, and the cabinet 100 is placed on the supporting surface through the four supporting rollers 900, with a certain space being formed between the bottom wall of the cabinet 100 and the supporting surface.

The heat dissipation fan 106 is configured to promote environmental air around the bottom air inlet 110*a* to enter the compressor chamber 300 from the bottom air inlet 110*a*, sequentially pass through the condenser 105 and the compressor 104, and then flow from the bottom air outlet 110*b* into an external environment to dissipate heat from the compressor 104 and the condenser 105. In a vapor compression refrigeration cycle, a surface temperature of the condenser 105 is generally less than that of the compressor 104, and thus the external air cools the condenser 105 first and then cools the compressor 104 in the process above.

In a preferred embodiment, a plate section 1161 of a back plate 116 (the rear wall of the compressor chamber 300) facing the condenser 105 is a continuous plate surface. That is, the plate section 1161 of the back plate 116 facing the condenser 105 is provided with no heat dissipation hole. The applicant creatively recognized that abnormal reduction in the ventilation area of the compressor chamber 300 without enlarging the heat dissipation area of the condenser 105 can form a better heat dissipation air flow path and can still achieve a relatively good heat dissipation effect. In the preferred solution of the present invention, the applicant broken through the conventional design idea to design the plate section 1161 of the rear wall (the back plate 116) of the compressor chamber 300 corresponding to the condenser 105 as the continuous plate surface, so that the heat dissipation air flow entering the compressor chamber 300 is sealed at the condenser 105 to enable more environmental air entering from the bottom air inlet 110*a* to be concentrated at the condenser 105, which ensures the heat exchange uniformity of each condensation section of the condenser 105 and is favorable for forming the better heat dissipation air flow path and also achieving a relatively good heat dissipation effect. Moreover, the plate section 1161 of the back plate 116 facing the condenser 105 is the continuous plate surface and is provided with no air inlet hole, so that the problems that in conventional design, air exhaust and air feeding are both concentrated at the rear part of the compressor chamber 300, which causes that the hot air blown from the compressor chamber 300 enters the compressor chamber 300 again without being cooled by the environmental air in time, causing adverse effects on heat exchange of the condenser 105 are avoided, and thus the heat exchange efficiency of the condenser 105 is guaranteed.

In some embodiments, two transverse side walls of the compressor chamber 300 are each provided with a side ventilation hole, and the side ventilation hole may be covered with a ventilation cover plate 108. Small grille type ventilation holes are formed in the ventilation cover plate 108. The housing of the refrigerator 10 includes two cabinet side plates 111 in a transverse direction. The two cabinet side plates 111 vertically extend to form two side walls of the refrigerator 10. The two cabinet side plates 111 are each provided with a side opening 111*a* communicated with the corresponding side ventilation hole, so that the heat dissipation air flow flows out of the refrigerator 10. Therefore, a heat dissipation path is further extended, and the heat dissipation effect of the compressor chamber 300 is guaranteed.

In some embodiments, the condenser 105 includes a first straight section 1051 transversely extending, a second straight section 1052 extending in a front-rear direction, and a transition curved section (not shown) for connecting the first straight section 1051 to the second straight section 1052, thereby forming an L-shaped condenser 105 with a proper heat exchange area. The plate section 1161 of the rear wall (the back plate 116) of the above-mentioned compressor chamber 300 corresponding to the condenser 105 is the plate section 1161 of the back plate 116 facing the first straight section 1051. The environmental air flow entering from the side ventilation holes exchanges heat directly with the second straight section 1052, and the environmental air entering from the bottom air inlet 110*a* exchanges heat directly with the first straight section 1051. Therefore, more environmental air entering the compressor chamber 300 is further concentrated at the condenser 105 to ensure the overall heat dissipation uniformity of the condenser 105.

The cabinet 100 further includes a specially-shaped plate 400, a supporting plate 112 and two side plates 119. The specially-shaped plate 400 includes a bottom horizontal section 113 located at a front side of the bottom and a bent section 401 bending and extending towards a rear upper side from a rear end of the bottom horizontal section 113. The bent section 401 extends to a position above the supporting plate 112. The supporting plate 112 and the bottom horizontal section 113 jointly form the bottom wall of the cabinet 100. The two side plates 119 extend upwards from two transverse sides of the supporting plate 112 to two transverse sides of the bent section 401 respectively to close two transverse sides of the compressor chamber 300 to form two transverse side walls of the compressor chamber 300. The back plate 116 extends upwards from a rear end of the supporting plate 112 to a rear end of the bent section 401 to form the rear wall of the compressor chamber 300.

Figure 10:
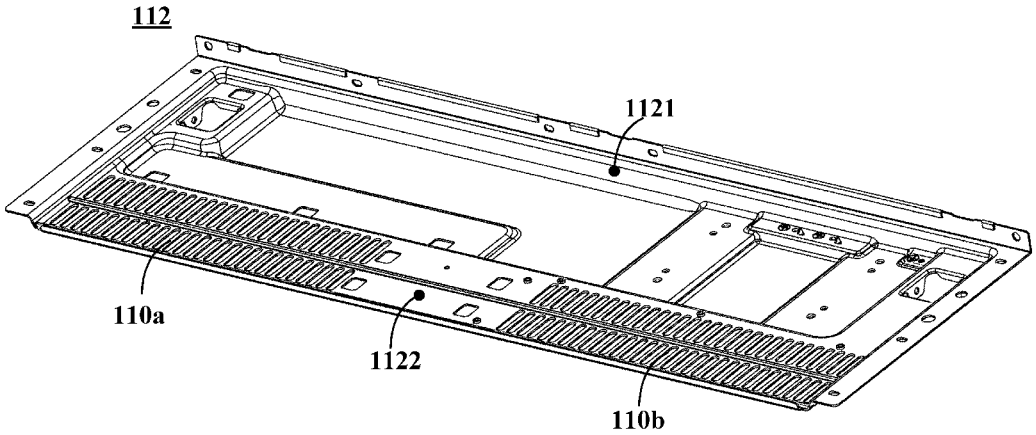
FIG. 10 is a schematic three-dimensional view of a supporting plate of the refrigerator shown in FIG. 6.

FIG. 10 is a schematic three-dimensional view of the supporting plate 112 of the refrigerator 10 shown in FIG. 6. Specifically, the supporting plate 112 includes a first section 1121 and a second section 1122 extending forwards from a front end of the first section 1121. The compressor 104, the heat dissipation fan 106 and the condenser 105 are sequentially arranged on the first section 1121 of the supporting plate 112 at intervals in a transverse direction and are located in a space defined by the supporting plate 112, the two side plates 119, the back plate 116 and the bent section 401. A front end of the second section 1122 is connected to the bottom horizontal section 113, and in the transverse direction, at an interval, the bottom air inlet 110*a* is formed in the side of the second section close to the condenser 105 and the bottom air outlet 110*b* is formed in the side of the second section close to the compressor 104. In the present embodiments of the present invention, the supporting plate 112 and the specially-shaped plate 400 are arranged such that the supporting plate 112 and the bottom horizontal section 113 jointly form the bottom wall of the cabinet 100, and a front end part of the supporting plate 112 is provided with the bottom air inlet 110*a* and the bottom air outlet 110*b*. The bottom air inlet 110*a* and the bottom air outlet 110*b* are composed of a plurality of ventilation holes respectively, so that the refrigerator 10 is anti-mouse. Meanwhile, this structure can greatly simplify an installation process of the refrigerator 10, i.e., only the compressor 104, the heat dissipation fan 106, the condenser 105, and the like need to be integrated on the supporting plate 112, and then the supporting plate 112 and the specially-shaped plate 400 are integrated to complete the installation of the bottom wall of the cabinet 100.

Figure 11:
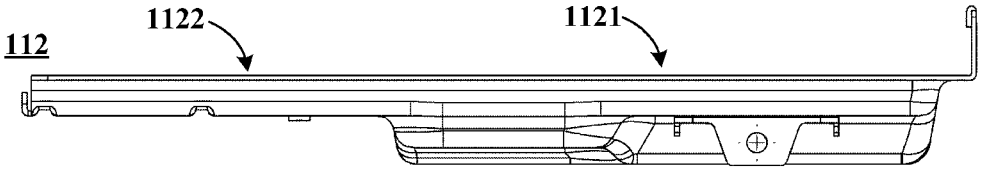
FIG. 11 is a schematic side view of the supporting plate of the refrigerator shown in FIG. 10.

FIG. 11 is a schematic side view of the supporting plate 112 of the refrigerator 10 shown in FIG. 10. In some embodiments, the first section 1121 is substantially horizontal, and the second section 1122 is substantially horizontal.

Figure 12:
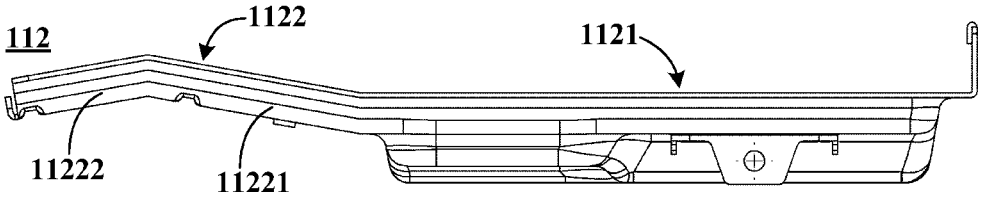
FIG. 12 is a schematic side view of a supporting plate of a refrigerator according to another embodiment of the present invention.

FIG. 12 is a schematic side view of a supporting plate 112 of a refrigerator 10 according to another embodiment of the present invention. In some other embodiments, the first section 1121 is substantially horizontal, and the second section 1122 has a first part 11221 and a second part 11222. The first part 11221 is formed by extending from the front end of the first section 1121 to a front upper side, and the second part 11222 is formed by extending from a front end of the first part 11221 to a front lower side. In a preferred embodiment, an included angle between the first part 11221 and a horizontal plane is less than 45°. In a more preferred embodiment, the included angle between the first part 11221 and the horizontal plane is 20° to 30°.

In some embodiments, the bent section 401 includes a first inclined section 1131, a second inclined section 114, a third inclined section 402, and a top horizontal section 115. The first inclined section 1131 extends upwards from a rear end of the bottom horizontal section 113, the second inclined section 114 extends from an upper end of the first inclined section 1131 to a rear upper side, the third inclined section 402 extends from an upper end of the second inclined section 114 to a rear upper side, and the top horizontal section 115 extends backwards from an upper end of the third inclined section 402 to the back plate 116 to shield upper sides of the compressor 104, the heat dissipation fan 106 and the condenser 105. In particular, the applicant creatively recognized that a slope structure of the bent section 401 is capable of guiding and rectifying feed air flow, so that the air flow entering from the bottom air inlet 110*a* flows more concentratedly to the condenser 105, avoiding that the air flow is too dispersed to pass more through the condenser 105, thereby further ensuring the heat dissipation effect of the condenser 105. Meanwhile, the slope structure of the bent section 401 guides exhaust air flow from the bottom air outlet 110*b* to a front side of the bottom air outlet, so that the exhaust air flow flows out of the compressor chamber 300 more smoothly, and thus the smoothness of air flow circulation is further improved.

In a preferred embodiment, the included angle between the first inclined section 1131 and the horizontal plane is slightly less than 90°, and an included angle between the second inclined section 114 and the horizontal plane and an included angle between the third inclined section 402 and the horizontal plane are both less than 45°. In this embodiment, the slope structure of the bent section 401 has better guiding and rectifying effect on the air flow. Furthermore, it is unexpected that the applicant creatively recognized that the slope structure of the bent section 401 achieves relatively good suppression effect on air flow noise. In prototype testing, the noise of the compressor chamber 300 with the foregoing particularly designed slope structure can be reduced by 0.65 decibel or above.

In addition, the bottom of the cabinet 100 of the traditional refrigerator 10 is usually an integrated carrying plate with a substantially flat plate type structure. The compressor 104 is arranged on an inner side of the carrying plate. Vibration generated in the operation of the compressor 104 has great impact on the bottom of the cabinet 100. In the present embodiment, as mentioned above, the bottom of the cabinet 100 is a three-dimensional structure formed by the specially-shaped plate 400 of a special structure and the supporting plate 112 to provide an independent three-dimensional space for arranging the compressor 104. The supporting plate 112 is used to carry the compressor 104 to reduce the influence of the vibration of the compressor 104 on other components at the bottom of the cabinet 100. In addition, the cabinet 100 is designed into the above ingenious special structure, so that the bottom of the refrigerator 10 is compact in structure and reasonable in layout, and the overall volume of the refrigerator 10 is reduced. Meanwhile, the space at the bottom of the refrigerator 10 is fully used, and the heat dissipation efficiency of the compressor 104 and the condenser 105 is guaranteed.

Figure 9:
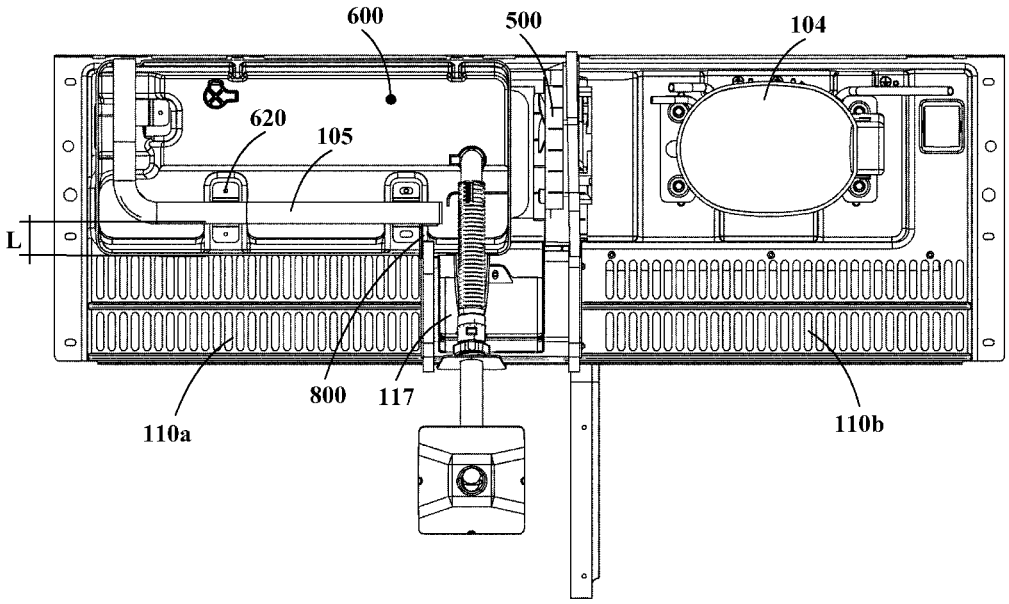
FIG. 9 is a schematic top view of a compressor chamber of the refrigerator shown in FIG. 6.

FIG. 9 is a schematic top view of the compressor chamber 300 of the refrigerator 10 shown in FIG. 6. In some embodiments, a gap is reserved between the front end surface of the condenser 105 and the bottom air inlet 110*a*, which means that the condenser 105 is shifted back under the condition that the position of the heat dissipation air inlet does not change. Those skilled in the art usually set the condenser 105 to be close to the heat dissipation air inlet as much as possible in a front-rear direction to save the space. However, the applicant creatively recognized that shifting the condenser 105 backwards can allow appropriate size reduction of the condenser 105, thereby saving more space.

In some embodiments, a distance L between the front end surface of the condenser 105 and the bottom air inlet 110*a* is not less than 10 cm, preferably 10 to 50 cm. In the refrigerator 10 of the embodiments of the present invention, a particular distance is reserved between the front end surface of the condenser 105 and the bottom air inlet 110*a*, which can reduce feed turbulence and reduce air feed resistance. The air feed volume is increased, and the feed air flow noise is reduced.

In some embodiments, an evaporating dish 600 of the refrigerator 10 is of a substantially cubic structure having an opening in the top, and has a bottom wall and four side walls extending upwards from the bottom wall. Supporting blocks 620 are respectively provided on the bottom wall of the evaporating dish 600 corresponding to the first straight section 1051 and the second straight section 1052 of the condenser 105. As shown in FIG. 9, the bottom wall of the evaporating dish 600 is provided with two supporting blocks 620 spaced in the transverse direction, and the bottom wall of the evaporating dish 600 is provided with one supporting block 620 in a vertical direction. The condenser 105 is provided with a supporting piece 1053 at its bottom. The supporting piece 1053 is fixed to the supporting block 620 to fix the condenser 105 in the evaporating dish 600, so that a lower end of a bottom of the condenser 105 is higher than a top end of a front wall of the evaporating dish 600. By increasing the height of the condenser 105 at the evaporating dish 600, the bottom of the condenser 105 is also exposed to external air flow, further guaranteeing the heat dissipation effect of the condenser 105.

Figure 13:
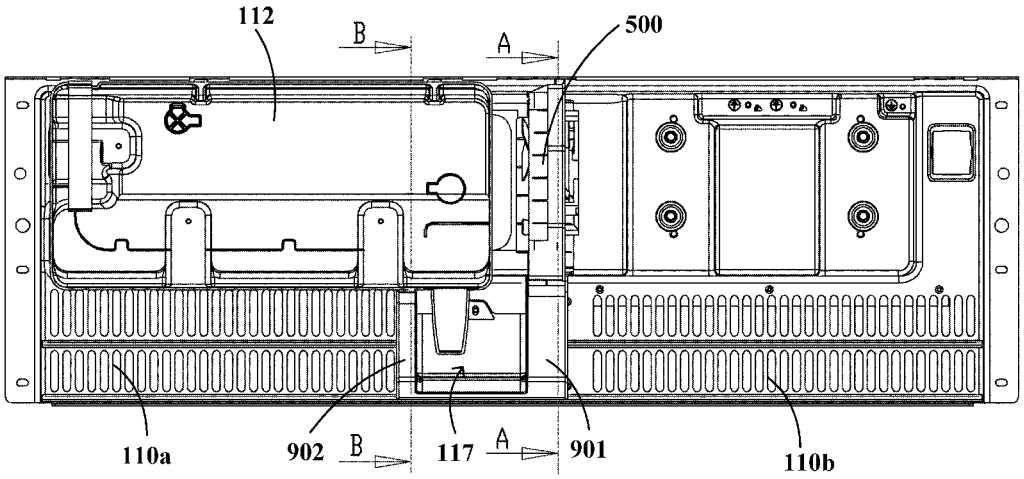
FIG. 13 is a schematic top view of partial components of the compressor chamber of the refrigerator shown in FIG. 6.

FIG. 13 is a schematic top view of partial components of the compressor chamber 300 of the refrigerator 10 shown in FIG. 6. In some embodiments, the refrigerator 10 further includes a divider 117 configured to completely isolate the bottom air inlet 110*a* from the bottom air outlet 110*b* to allow external air to enter the compressor chamber 300 via the bottom air inlet 110*a* located on one transverse side of the divider 117 under the action of the heat dissipation fan 106, sequentially flow through the condenser 105 and the compressor 104, and finally flow out from the bottom air outlet 110*b* located on the other transverse side of the divider 117, such that the external air entering the condenser 105 and heat dissipation air discharged from the compressor 104 are not crossed.

In some embodiments, the refrigerator 10 further includes a fan fixing frame 500. The fan fixing frame 500 is fixed in the compressor chamber 300 in a front-rear direction and used to fix the heat dissipation fan 106. The divider 117 is fixed to the fan fixing frame 500, so that on one hand, the installation stability of the divider 117 can be guaranteed; and on the other hand, noise generated by vibration of the heat dissipation fan 106 can be reduced.

In some embodiments, the divider 117 is also fixed to the evaporating dish 600. In this way, the installation stability of the divider 117 can be further improved.

Figure 14:
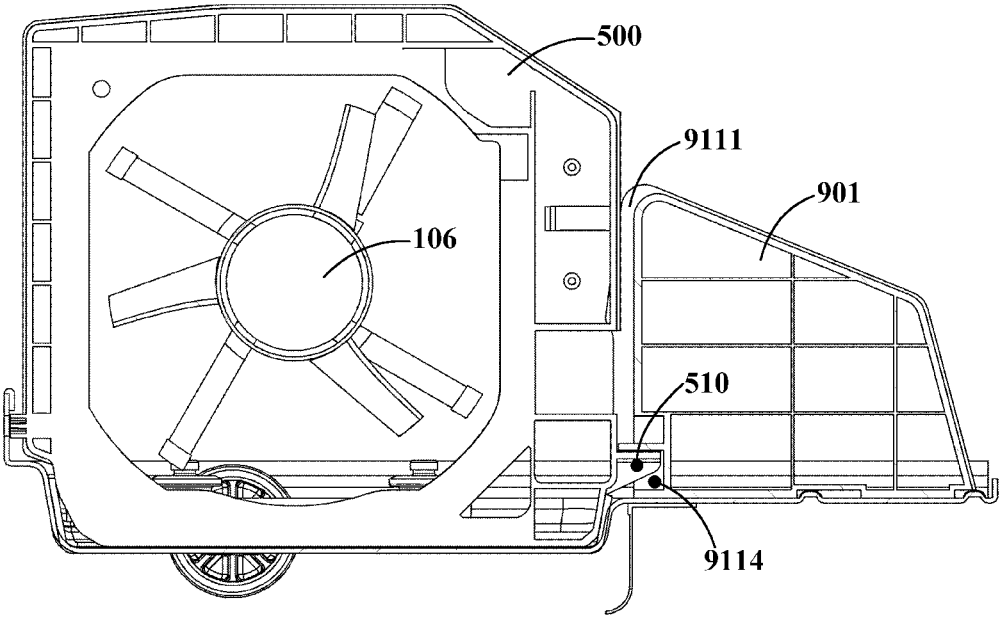
FIG. 14 is a schematic cross-sectional view along Line A-A of FIG. 13.
Figure 15:
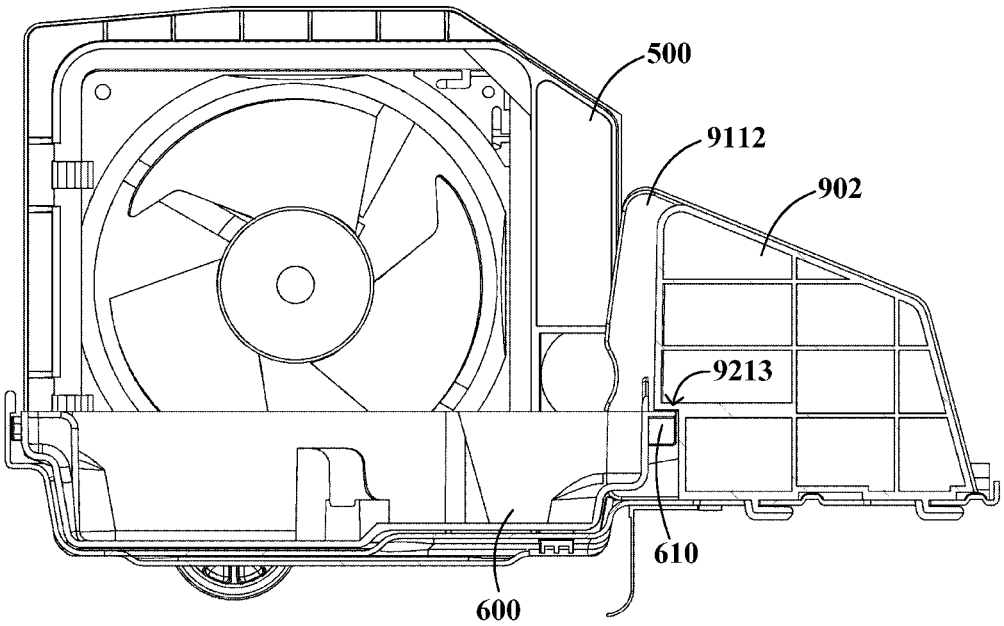
FIG. 15 is a schematic cross-sectional view along Line B-B of FIG. 13.
Figure 16:
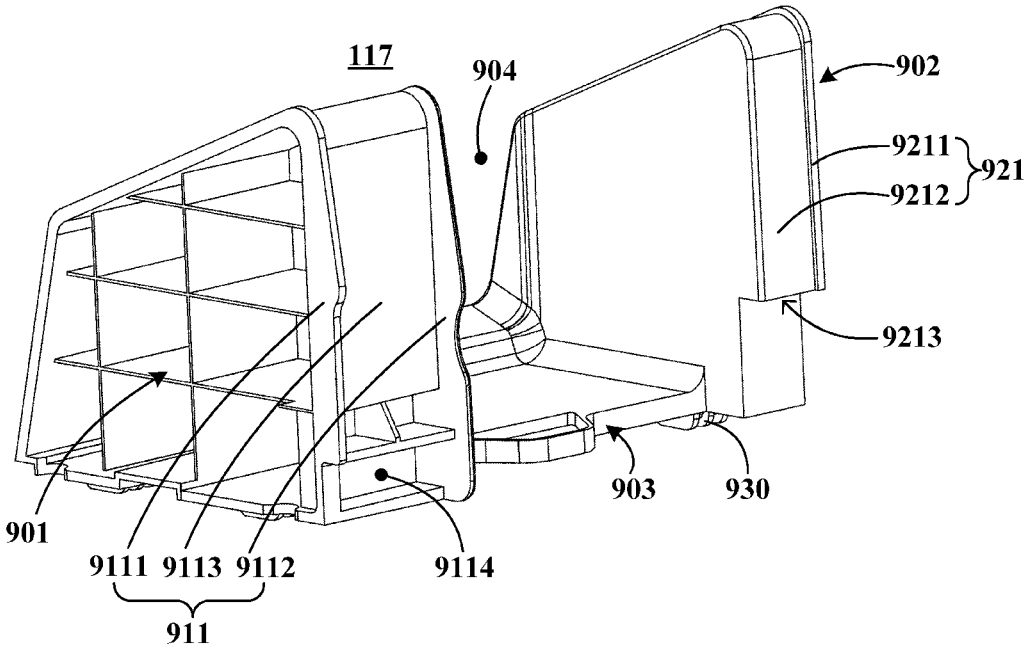
FIG. 16 is a schematic three-dimensional view of a divider of the refrigerator shown in FIG. 6.

In preferred embodiments, the divider 117 is arranged behind the bent section 401, and a front part thereof is connected to the rear end of the bottom horizontal section 113, and a rear part thereof is fixed to the fan fixing frame 500 and the evaporating dish 600 respectively. FIG. 14 is a schematic cross-sectional view along Line A-A of FIG. 13. FIG. 15 is a schematic cross-sectional view along Line B-B of FIG. 13. FIG. 16 is a schematic three-dimensional view of the divider 117 of the refrigerator 10 shown in FIG. 6. The divider 117 has a first separation part 901, a second separation part 902 and a bottom connection part 903 therebetween. A rear part 911 of the first separation part 901 includes a main body part 9113, a first flange 9111 and a second flange 9112. An accommodating slot 9114 is formed in the main body part 9113. The first flange 9111 and the second flange 9112 are formed by extending backwards from left and right sides of a rear end of the main body part 9113 respectively. A front part of the fan fixing frame 500 is clamped between the first flange 9111 and the second flange 9112. A front end of the fan fixing frame 500 extends forwards to form a protrusion 510. The protrusion 510 of the fan fixing frame 500 is fitted in the accommodating slot 9114 to realize snap fixing between the divider 117 and the fan fixing frame 500. A rear part 921 of the second separation part 902 includes a main body part 9212 and a flange 9211 formed by extending backwards on the side of the main body part 9212 close to the evaporating dish 600. A lower part of the main body part 9212 is recessed forwards to form a horizontal abutting surface 9213. A protrusion 610 extending forwards is formed on a front wall of the evaporating dish 600, and the protrusion 610 of the evaporating dish 600 is fitted below the horizontal abutting surface 9213 to realize fixing of the divider 117 and the evaporating dish 600 by abutting against each other.

A plurality of claws 930 extending downwards are formed on the bottom connection part 903, and the supporting plate 112 is provided with clamping holes at corresponding positions. The divider 117 is fixed to the supporting plate 112 by fixing the claws 930 in the clamping holes.

When there is a gap between the front end surface of the condenser 105 and the bottom air inlet 110*a*, there is also a gap between the divider 117 and the evaporating dish 600, so that the divider 117 can completely isolate the bottom air inlet 110*a* from the bottom air outlet 110*b* by arranging a baffle plate 800 at the gap. In an embodiment, the baffle plate 800 is provided between the rear part 921 of the second separation part 902 and the first straight section 1051 of the condenser 105. The baffle plate 800 may be an integral part or a split assembly, as long as it can shield the gap between the front end surface of the condenser 105 and the divider 117.

In addition, a notch 904 is formed among the first separation part 901, the second separation part 902, and the bottom connection part 903 to provide a space for connecting a water guide pipe 700 of the refrigerator 10 to the evaporating dish 600. In the present application, the divider 117 is preferably an integrally molded plastic part, which can simplify the production process and installation process of the divider 117.

In some embodiments, the upper end of the condenser 105, the upper end of the fan fixing frame 500, and an upper end of the divider 117 are further provided with an air shield member 1056, respectively. The air shield member 1056 may be air shield sponge, which charges a space between the upper end of the condenser 105 and the bent section 401, a space between the upper end of the fan fixing frame 500 and the bent section and a space between the upper end of the divider 117 and the bent section respectively. Specifically, for the condenser 105, the air shield member 1056 covers the upper ends of the first straight section 1051, the second straight section 1052, and the transition curved section, and the upper end of the air shield member 1056 abuts against an inner surface of the bent section 401 to seal the upper end of the condenser 105, so as to prevent part of the air entering the compressor chamber 300 from passing through the space between the upper end of the condenser 105 and the bent section 401, instead of passing through the condenser 105, so that the air entering the compressor chamber 300 exchanges heat through the condenser 105 as much as possible to further enhance the heat dissipation effect of the condenser 105. For the fan fixing frame 500, the air shield member 1056 covers the upper end of the fan fixing frame 500, and the upper end of the air shield member 1056 abuts against the inner surface of the bent section 401. For the divider 117, the air shield member 1056 covers the upper ends of the first separation part 901 and the second separation part 902, and the upper end of the air shield member 1056 abuts against the inner surface of the bent section 401.

In some embodiments, the refrigerator 10 further includes an air shield bar 107 extending in the front-rear direction. The air shield bar 107 is located between the bottom air inlet 110*a* and the bottom air outlet 110*b*, and extends from a lower surface of the bottom horizontal section 113 to a lower surface of the supporting plate 112, so that when the refrigerator 10 is placed on a supporting surface, it transversely divides a space between the bottom wall of the cabinet 100 and the supporting surface, so as to allow the external air to enter the compressor chamber 300 via the bottom air inlet 110*a* located on one transverse side of the air shield bar 107 under the action of the heat dissipation fan 106, sequentially flow through the condenser 105 and the compressor 104, and finally flow out from the bottom air outlet 110*b* located on the other transverse side of the air shield bar 107, thereby completely isolating the bottom air inlet 110*a* from the bottom air outlet 110*b*, ensuring that the external air entering the condenser 105 and the heat dissipation air discharged from the compressor 104 are not crossed, and further ensuring the heat dissipation efficiency.

In the refrigerator 10 of the embodiments of the present invention, the cooling chamber 200 is defined in the bottom, and the freezing chamber 132 is defined above the cooling chamber 200, so that the cooling chamber 200 occupies a lower space in the freezing liner 130, the freezing chamber 132 is raised, the user has no need to bend down much to access to the freezing chamber 132, and the use experience is improved. In addition, by the divider 117, the bottom air inlet 110*a* and the bottom air outlet 110*b* are completely separated, so that the external air entering the condenser 105 and the heat dissipation air discharged from the compressor 104 are not crossed.

Further, the divider 117 of the refrigerator 10 of the embodiments of the present invention is fixed to the fan fixing frame 500, so that on one hand, the installation stability of the divider 117 can be guaranteed; and on the other hand, noise generated by vibration of the heat dissipation fan 106 can be reduced.

Further, the divider 117 of the refrigerator 10 of the embodiments of the present invention is also fixed to the evaporating dish 600 and the supporting plate 112, and is convenient to install and stable.

Hereto, those skilled in the art should realize that although multiple exemplary embodiments of the present invention have been shown and described in detail herein, many other variations or modifications that conform to the principles of the present invention can still be directly determined or deduced from contents disclosed in the present invention without departing from the spirit and scope of the present invention. Therefore, the scope of the present invention should be understood and recognized as covering all these other variations or modifications.

The invention claimed is:

1. A refrigerator, comprising:

a cabinet in which a cooling chamber located at a lower side and at least one storage compartment located above the cooling chamber are defined, a bottom air inlet and a bottom air outlet being formed in a bottom of the cabinet in a transverse direction at an interval;

a compressor chamber arranged behind the cooling chamber, in which a compressor, a heat dissipation fan and a condenser are sequentially arranged; and a divider configured to completely isolate the bottom air inlet from the bottom air outlet to allow external air to enter the compressor chamber via the bottom air inlet located on one transverse side of the divider under the action of the heat dissipation fan, sequentially flow through the condenser and the compressor, and finally flow out from the bottom air outlet located on the other transverse side of the divider, such that the external air entering the condenser and heat dissipation air discharged from the compressor are not crossed; and a fan fixing frame fixed in the compressor chamber in a front-rear direction and used to fix the heat dissipation fan, wherein the divider is fixed to the fan fixing frame, wherein the divider is snap-fixed to the fan fixing frame, wherein the divider has a first vertically extending partition close to the bottom air outlet, and an accommodating slot is formed in a rear end of the first vertically extending partition;

a front end of the fan fixing frame extends forwards to form a protrusion; and the protrusion of the fan fixing frame is fitted in the accommodating slot to realize snap fixing between the divider and the fan fixing frame.

2. The refrigerator according to claim 1, wherein a rear part of the first vertically extending partition comprises a main body part, a first flange and a second flange, the accommodating slot is formed in the main body part, and the first flange and the second flange are formed by extending backwards from left and right sides of a rear end of the main body part respectively; and a front part of the fan fixing frame is clamped between the first flange and the second flange.

3. The refrigerator according to claim 1, further comprising:

an evaporating dish fixed in the compressor chamber, wherein the condenser is arranged in the evaporating dish; and the divider is fixed to the evaporating dish.

4. The refrigerator according to claim 3, wherein the divider is fixed to the evaporating dish by abutting against each other.

5. The refrigerator according to claim 4, wherein the divider has a second vertically extending partition close to the bottom air inlet, and a lower part of a rear end of the second vertically extending partition is sunken forwards to form a horizontal abutting surface;

a front wall of the evaporating dish extends forwards to form a protrusion; and the protrusion of the evaporating dish is fitted below the horizontal abutting surface to realize fixing of the divider and the evaporating dish by abutting against each other.

6. The refrigerator according to claim 1, further comprising:

a supporting plate configured to be bottoms of the cabinet and the compressor chamber;

the divider is provided with a plurality of claws at its bottom;

the supporting plate is correspondingly provided with a plurality of clamping holes; and the plurality of claws are fixed to the plurality of clamping holes so that the divider is fixed to the supporting plate.

7. The refrigerator according to claim 1, wherein the divider is an integrally molded piece.

8. The refrigerator according to claim 1, further comprising: an evaporator arranged in the cooling chamber and configured to cool an air flow entering the cooling chamber.

* * * * *